US005148691A

United States Patent [19]

Walldén

[11] Patent Number: 5,148,691

[45] Date of Patent: Sep. 22, 1992

[54] ELECTRICALLY AND MECHANICALLY ACTIVATABLE LOCK MECHANISM

[75] Inventor: Lars Walldén, Eskilstuna, Sweden

[73] Assignee: ASSA AB, Sweden

[21] Appl. No.: 778,976

[22] PCT Filed: May 19, 1990

[86] PCT No.: PCT/SE90/00402

§ 371 Date: Dec. 27, 1991

§ 102(e) Date: Dec. 27, 1991

[87] PCT Pub. No.: WO91/00405

PCT Pub. Date: Jan. 10, 1991

[30] Foreign Application Priority Data

Jun. 29, 1989 [SE] Sweden ..... 8902363-4

[51] Int. Cl.[5] ..... E05B 47/00

[52] U.S. Cl. ..... 70/279; 292/201

[58] Field of Search ..... 70/277-283; 292/144, 201

[56] References Cited

U.S. PATENT DOCUMENTS

| | | | |
|---|---|---|---|
| 4,126,341 | 11/1978 | Bradstock | 292/201 |
| 4,438,962 | 3/1984 | Soloviff et al. | 292/144 |
| 4,519,227 | 5/1985 | Dumbser et al. | 70/280 X |
| 4,520,914 | 6/1985 | Kagiyama et al. | 292/201 X |
| 4,685,709 | 8/1987 | Kambic | 292/201 |
| 4,779,912 | 10/1988 | Ikeda et al. | 292/201 X |
| 4,833,465 | 5/1989 | Abend et al. | 292/144 X |

FOREIGN PATENT DOCUMENTS

| | | | |
|---|---|---|---|
| 1175088 | 7/1964 | Fed. Rep. of Germany | 70/277 |
| 3412136A1 | 10/1985 | Fed. Rep. of Germany . | |
| 445055 | 5/1986 | Sweden . | |
| 8602601 | 6/1986 | Sweden . | |
| 453107 | 1/1988 | Sweden . | |

*Primary Examiner*—Lloyd A. Gall

*Attorney, Agent, or Firm*—Sughrue, Mion, Zinn, Macpeak & Seas

[57] ABSTRACT

A lock mechanism of the narrow-profile-lock kind comprises a pivotal latch hook (4) which can be manipulated by a key via a cylinder-lock follower (19), a rack element (18), a follower (17) and a spring-activated drive element (6). The lock plunger can also be activated via an electric motor (11), an output shaft (10), and a worm gear (9) which is in meshing engagement with a dogging element (8) which is pivotally mounted on the same shaft (7) as the follower element (17) and has dogs or projections (**8*b*) which enter sector-shaped slots (17*b*) having a figure-eight configuration. When the electric motor is started the dogging element (8) is rotated through 90° and the latch hook (4) adopts its locking position. The electric motor returns immediately the dogging element (8) to its starting position, while the follower element (17**) remains.

5 Claims, 2 Drawing Sheets

ELECTRICALLY AND MECHANICALLY ACTIVATABLE LOCK MECHANISM

FIELD OF THE INVENTION

The present invention relates to an electrically and mechanically activatable lock mechanism, particularly, but not exclusively, a so-called narrow profile lock and more specifically to a lock mechanism of the kind set forth in the preamble of claim 1.

Such locks are used in many different connections, although are preferably used together with so-called profiled doors with which the space available for the lock housing is normally small.

Furthermore, high demands are placed on the security aspect of the lock mechanism and on its functional utility. The lock mechanism is normally activated electrically and consequently the electrical and mechanical components of the lock mechanism must be functionally reliable.

If a fault occurs in the electrical system, it is important that the lock can be manipulated mechanically with the aid of a key, i.e. independently of the electrical system and in the position occupied by the lock bolt or plunger when the fault occured.

BACKGROUND ART

A known electrically and mechanically actuable lock mechanism is described and illustrated in SE,B,445 055 (Beudat). One characteristic feature of this lock mechanism, however, is that the electrically actuable lock unit is latched against displacement in a given position, which means that when a fault occurs in the electrical system, the lock cannot be opened with the air of a key, unless physically tampering with the actual lock mechanism, which can be a relatively complicated process.

Further examples of lock mechanism forming part of the present standpoint of techniques are found described and illustrated in SE,E,8602601-0, DE,B,3 412 136, SE,B,453 107, U.S. Pat. No. 4,438,962, U.S. Pat. No. 4,685,709 and U.S. Pat. No. 4,126,341.

None of these known lock mechanism are concerned with a simple narrow-profile lock which comprises essentially standard components and which circumvents the aforesaid drawback.

OBJECTS OF THE INVENTION

Accordingly, an object of the present invention is to provide a lock of the aforesaid kind which can be manipulated both electrically and mechanically quite independently of one manipulating mode to the other and which can be manipulated mechanically with the aid of a key irrespective of the position in which the lock bolt or plunger is found in the event of a fault in the electrical system.

Another object is to provide a lock mechanism having the aforesaid advantageous function and being of simple and robust design and comprising essentially standard components and fulfilling the requirements demanded of a so-called narrow profile lock when only a small space is available for housing said lock.

SUMMARY OF THE INVENTION

These and other objects are fulfilled with a lock mechanism of the aforesaid kind which has the characteristic features set forth in the characterizing clause of the following claim 1.

The combination of a cylinder follower provided with centrally disposed sector-shaped slots and mounted on the same shaft as the adjacent dogging or transmission element, which is provided with dogs or projections which engage in said slots, the dogging element is able to activate the cylinder follower, subsequent to a start impulse to the drive motor, so that the lock bolt or plunger will swing from its free position to its locking position or vice versa. Furthermore, since the arrangement is such that the motor, subsequent to rotating to its terminal position, receives an impulse which causes the motor to return immediately to its starting position, the dogging element will accompany said movement while the cylinder follower will remain in the position adopted.

Thus, the transmission or dogging element will always adopt a neutral position (except when it moves to or from its second terminal position, which takes place in a sequence) in which the lock mechanism can be manipulated mechanically with the aid of a key.

Mechanical manipulation of the lock with the aid of a key is thus always possible, irrespective of whether or not a fault occurs in the electrical system and irrespective of the position in which the lock plunger or bolt is located on the occurence of such a fault.

The lock components may comprise simple standard components, the components used primarily being those used in earlier known constructions of so-called narrow profile locks having pivotal latch hooks.

In order to enable the dimensions of the components associated with the electrical drive arrangement to be reduced and their reliability to be enhanced, the drive device which coacts with the dogging element will preferably have the form of a worm gear mounted on the output shaft of the motor.

The output shaft will preferably extend adjacent that side of the lock housing which lies opposite the side provided with an aperture for accommodating the latch bolt. The components associated with the electrical drive device can herewith be given small dimensions and can be placed in the lock housing so as not to encroach on the spaced required for the remaining components of the lock mechanism.

Furthermore, by mounting the transmission or dogging element on the same shaft as the follower element provided with said slot and closely adjacent said follower element, it will be seen that these components essential to the function of the lock will occupy the least possible space in the lock housing.

The transmission and dogging element will also preferably include a small magnet which is intended to coact with a circuit card and which indicates the position in which the dogging element is located prior to returning to its neutral position, i.e. whether the lock is open or closed. This enables the electric drive motor to receive correct information, so that a start impulse will cause the drive motor to rotate in the correct direction.

Further characteristic features of the invention will be apparent from the following description, made with reference to a preferred embodiment of the invention and with reference to the accompanying drawings.

DESCRIPTION OF THE PREFERRED EMBODIMENT

Figure 1:
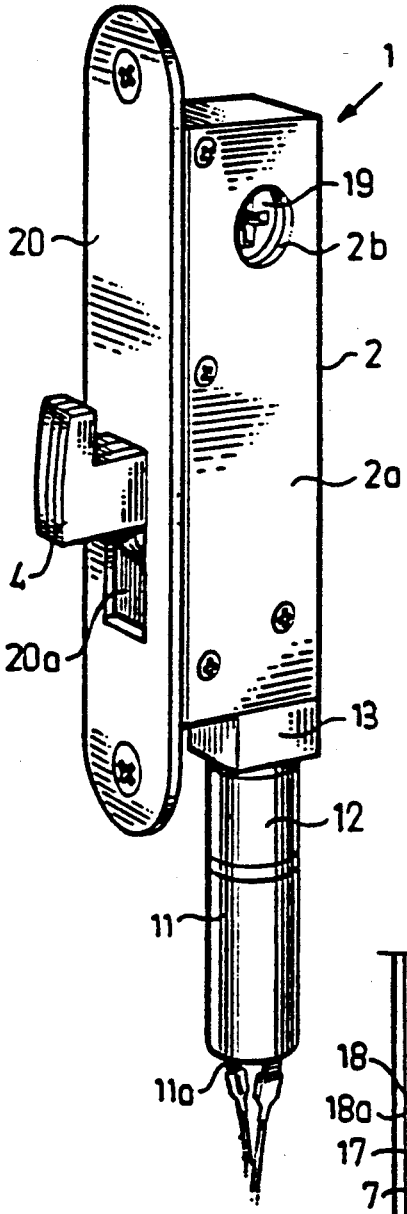
FIG. 1 is a perspective view of a narrow profile lock according to the invention, and shows the latch hook of the lock in its locking position.

FIG. 1 illustrates a so-called narrow profile lock having a lock housing 2, the front side of which is covered by a faceplate 20 in which an aperture 20*a* is provided for accommodation of a latch hook 4.

Formed in one side surface 2*a* of the lock housing is a circular hole 2*b*, in which the dogging element of a cylinder lock is accommodated for coaction with a cylinder follower 19.

The other side surface 2*c* of the lock housing has a corresponding hole for accommodating a further dogging element, which may have the form, for instance, of a knob or a further cylinder follower.

The lock mechanism is thus manipulated with the aid of a key, in a conventional manner, via a cylinder lock from at least one side of the housing.

The lock is manipulated mechanically via a projection 19*a* on the cylinder-lock follower 19, which when the key is turned enters a notch or cut-out 18*b* provided in a gear-rack element 18 which can be moved in the direction of its longitudinal axis. In turn, as will be seen from FIGS. 3 and 5, this activates a follower element 17 which is rotatably mounted on a shaft 7 and which has teeth 17*a* which mesh with teeth 6*a* on a drive element 6 pivotally mounted on a pivot shaft 5.

The drive element 6 is biased by a spring 27 and, by means of a dogging element 5*b*, is brought into engagement with a slot 4*b* provided in the central part 4*a* of the latch hook 4, said central part having roughly the shape of a circle segment.

Figure 2:
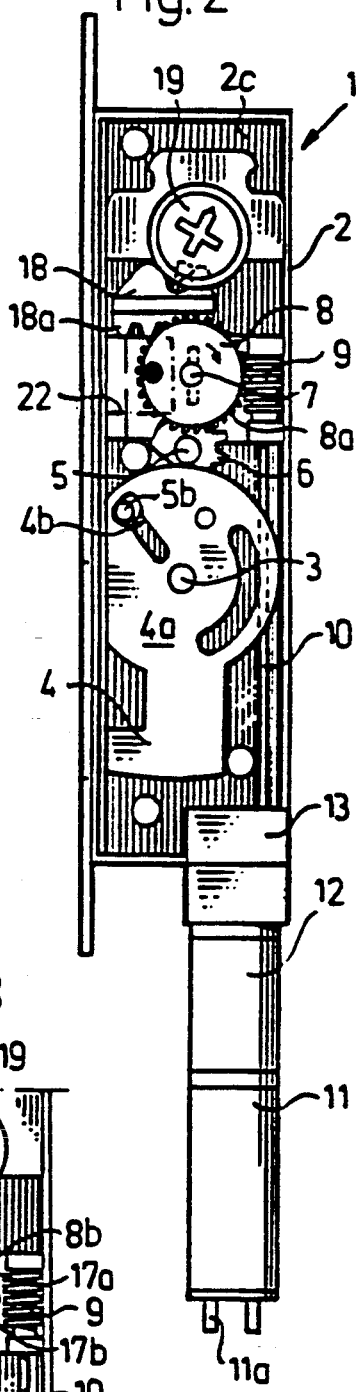
FIG. 2 is a view of the lock housing from above, with the lock cover removed and shows the lock plunger in its lock release position.
Figure 3:
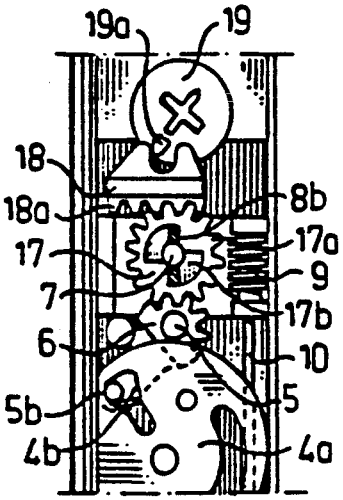
FIG. 3 illustrates part of FIG. 2, with the transmission or dogging element of the lock mechanism omitted so as to show the underlying follower element.
Figure 4:
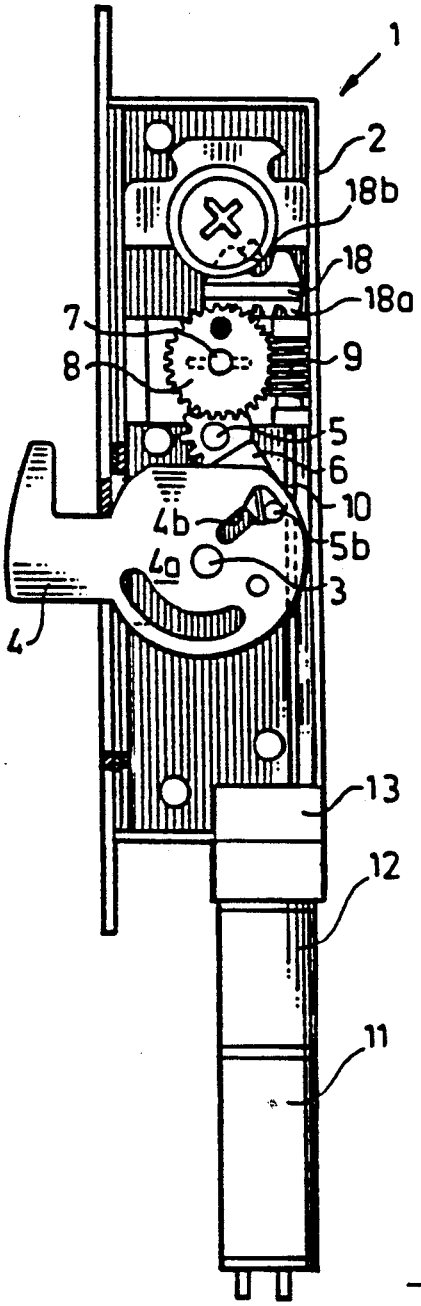
FIG. 4 is a view from above corresponding to FIG. 2, but with the lock plunger in its locking position.
Figure 5:
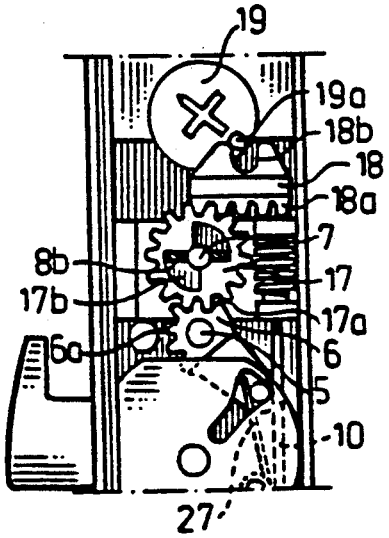
FIG. 5 is a part view corresponding to FIG. 3, with the lock plunger in its locking position and with the transmission or dogging element omitted.

Rotation of the cylinder follower 19 from the position illustrated in FIG. 3 to the position illustrated in FIG. 5 will therewith cause corresponding displacement of the rack element 18, rotation of the follower element 17, pivoting of the drive element 6 and outward swinging of the latch hook 4 from the free position shown in FIGS. 2 and 3 to the latching position shown in FIGS. 1, 4, 5 and 6.

The described components of a narrow profiled lock of the aforesaid kind, and the manner in which said components function, belong to prior standards and corresponding standpoints of techniques.

The narrow profiled lock can also be manipulated electrically, and to this end includes an electric motor 11 provided with two sequentially disposed gearwheels 12, 13 which function to reduce the rotary speed of the output shaft 10. Mounted on one end of the output shaft is a worm gear 9 which functions as a drive means and which meshes with teeth 8*a* on a dogging or transmission element 8, as described in more detail herebelow.

Figure 7:
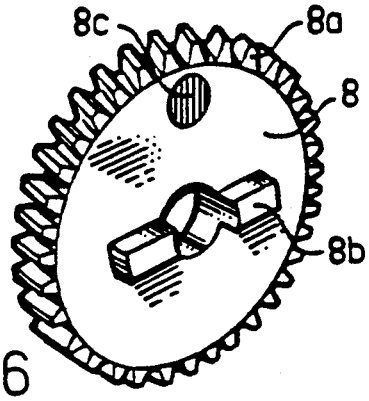
FIG. 7, finally, is a perspective view of the transmission or dogging element.
Figure 6:
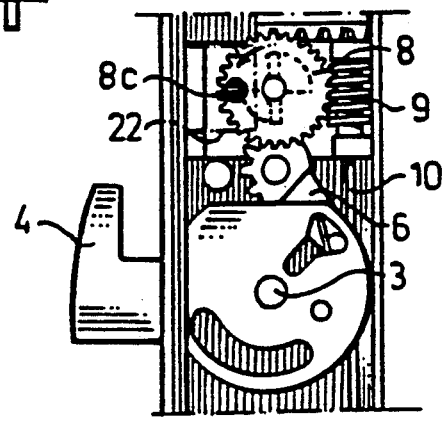
FIG. 6 shows part of the view of FIG. 4 subsequent to the transmission or dogging element returning to its neutral position, after having rotated through 80° and activating the cylinder follower element and swinging-out the lock plunger.

The dogging element is shown in perspective in FIG. 7 and also in a view from above in FIGS. 2, 4 and 6, whereas the dogging element is omitted in the views of FIGS. 3 and 5.

The dogging element 8 is pivotally mounted on the same shaft 7 as the follower element 17 and is located closely adjacent said follower element. On its side facing towards the follower element 17, the dogging element has two dogging dogs or projections 8*b*, also shown in FIGS. 3 and 5, in which FIGS. the element is conceived to be cut along the projection-bearing side surface, i.e. so that the dogs are shown as broken-line surfaces in FIGS. 3 and 5.

The projections enter respective circle-sector slots 17*b* in the follower element 17, these slots together roughly forming a figure-eight configuration. When the lock mechanism is to be brought to its locking mode electrically, a switch (not shown) connected to the electric motor 11 is activated, wherewith the motor rotates a number of revolutions which subsequent to being stepped down in the planet gears 12 and 13 cause the worm gear 9 to rotate and therewith cause the auxiliary element 8 to turn through 90°, from the position shown in FIG. 2 to the position shown in FIG. 4. The dogs 8*b* engaging in respective sector-shaped slots 17*b* in the follower element 17 transmit this rotary movement to the follower element, which consequently also rotates through 90°, namely from the position shown in FIG. 3 to the position shown in FIG. 5, causing the latch hook 4 to be swung out.

The electric motor is constructed to immediately execute a corresponding rotary movement in the opposite direction, therewith causing the dogging element 8 to return immediately to its starting or neutral position. This is illustrated in FIG. 6, which also shows that no corresponding movement of the follower element 17 takes place, i.e. the latch hook 4 remains in its latching position.

The latch hook 4 can now be returned to its lock release position illustrated in FIGS. 2 and 3, either with the aid of the electric motor 11, which causes the dogging element 8 to rotate anti-clockwise from the FIG. 6 position in the aforedescribed manner, said dogs 8*b* activating the follower element 17 and causing said element to rotate back through 90° from the position illustrated in FIG. 5 to the position illustrated in FIG. 3. The rack element 18 will herewith be moved from the position shown in FIG. 5 to the position shown in FIG. 3. The latch hook is activated, at the same time, via the drive element 6.

A corresponding functional sequence can also be achieved manually with the aid of a key or knob which activates the cylinder follower 19 so as to displace the rack element 18, in the aforedescribed manner.

Since the dogging element 8 is therewith located in its starting or neutral position shown in FIGS. 2 and 6, the electric motor or the components associated with operation of the electric motor will not prevent the lock from being released manually, or render such manual release difficult.

Correspondingly, locking from the release position shown in FIGS. 2 and 3 can be effected manually without hinderance from the electric motor 11 or from the components associated with the operation of said motor.

Consequently, should a fault occur in the electrical drive system, the lock can always be opened or secured manually with the aid of a key. As will be evident from the aforegoing, this can be achieved directly, without needing to enter the lock housing.

The dogging or transfer element 8 is provided with a magnet 8*c* intended for coaction with a circuit card 22. The arrangement is such that when a switch is manipulated for movement of the lock plunger in either direction, the electric motor will only receive a corresponding impulse for movement of the motor in said either direction in accordance with a preprogrammed movement, when the magnet 8*c* is located in the position corresponding to the starting or neutral position of the dogging element, said movement being immediately followed by return movement in the opposite direction.

It will be evident from the aforegoing that the majority of the components associated with the electrical drive arrangement comprise standard components. The only essentially novel component is the dogging or transfer element 8, the configuration of which is adapted in relation to the follower element 17 with its slot 17*b* so that the aforedescribed operational sequences can be achieved.

The use of a worm screw 9 as a means for driving the dogging element 8 means that the electrical drive arrangement will require only a small space adjacent the side surface of the lock housing 2 opposite the faceplate 20, i.e. the incorporation of an electric motor drive does not encroach on the space available in the lock housing to any great extent.

The electric motor 11 itself can be housed in a housing or casing part (not shown) forming an extension of the lock housing 2.

I claim:

1. An electrically and mechanically activatable lock mechanism in the form of a narrow profile lock, comprising:

a) a lock housing (2), b) a lock plunger in the form of a latch hook (4) pivotally mounted on a shaft (3), c) a toothed, spring-activated drive element (6) pivotally mounted on a shaft (5) and operative to pivot the lock plunger between a lock-release position and a locking position, d) a toothed, pivotal transmission/dogging element in engagement with a drive means (9) mounted on an output shaft (10) of an electric motor (11), e) a toothed follower element (17) operative to coact with the transmission/dogging element (8) and being in meshing engagement with the drive element (6) and with a rectilinearly movable rack element (18), f) a pivotal cylinder lock follower (19) having a projection (19*a*) for engagement with a notch (18*a*) in the rack element (18), wherein the follower element (17) is pivotally mounted on a shaft (7) which also supports the transmission/dogging element (8) and is located adjacent said transmission/dogging element and presents a known central slot (17*b*) having two sector-shaped parts defining a figure-eight configuration, said transmission/dogging element (8) having dogs (8*b*) which engage in said two sector-shaped parts of said slot; and wherein the electric motor (11), subsequent to receiving a start impulse, functions to rotate the transmission/-dogging element (8) through part of one revolution, via said output shaft (10) and said drive means (9), said rotary movement being transmitted via the dogs (8*b*) to the follower element (17) so as to pivot said lock plunger, and thereafter to return immediately said transmission/dogging element (8) to its starting position, said follower element (17) remaining in its adopted position.

2. A lock mechanism according to claim 1, wherein the drive means comprises a worm gear (9) mounted on one end of the output shaft (10).

3. A lock mechanism according to claim 1 or 2, wherein the output shaft (10) extends adjacent a side of the lock housing (2) which lies opposite a side (20) which presents an aperture (20*a*) for accommodating the lock plunger.

4. A lock mechanism according to claim 1 or 2, wherein the electric motor (11) comprises two gears (12, 13) arranged one after the other for stepping-down movement of the output shaft (10).

5. A lock mechanism according to claim 1 or 2, wherein the transmission/dogging element (8) is provided with a magnet (8*c*) for coaction with a circuit card (22) which functions to prevent a start impulse being sent to the electric motor (11) when the transmission/dogging element (8) is not located in its starting or neutral position.

* * * * *